US005213679A

United States Patent [19]

Bourgogne et al.

[11] Patent Number: 5,213,679

[45] Date of Patent: May 25, 1993

[54] PROCESS FOR THE CATALYTIC CONVERSION OF A HYDROCARBON FEEDSTOCK

[75] Inventors: Michel Bourgogne, Le Havre; Jean-Claude Courcelle, Montivilliers; Claude Marty, Le Havre, all of France

[73] Assignee: Compagnie de Raffinage et de Distribution Total France, Paris, France

[21] Appl. No.: 597,860

[22] Filed: Oct. 15, 1990

[30] Foreign Application Priority Data

Oct. 13, 1989 [FR] France ..... 89 13447

[51] Int. Cl.[5] ..... C10G 11/00

[52] U.S. Cl. ..... 208/48 AA; 208/114

[58] Field of Search ..... 208/48 AA, 114

[56] References Cited

U.S. PATENT DOCUMENTS

| | | | |
|---|---|---|---|
| 3,558,470 | 1/1971 | Gillespie et al. | 208/48 AA |
| 3,647,677 | 3/1972 | Wolff et al. | 208/48 |
| 4,024,048 | 5/1979 | Shell et al. | 208/48 AA |
| 4,263,131 | 4/1981 | Bertus et al. | 208/114 |
| 4,321,128 | 3/1982 | Yoo | 208/114 |
| 4,356,338 | 10/1982 | Young | 208/114 |
| 4,425,223 | 1/1984 | Miller | 208/48 AA |
| 4,430,199 | 2/1984 | Durante et al. | 208/114 |
| 4,430,199 | 2/1984 | Durante et al. | 208/114 |
| 4,456,780 | 6/1984 | Young | 208/114 |
| 4,752,374 | 6/1988 | Reid | 208/48 AA |

FOREIGN PATENT DOCUMENTS 0147961 10/1985 European Pat. Off. .

*Primary Examiner*—Theodore Morris
*Assistant Examiner*—David M. Brunsman
*Attorney, Agent, or Firm*—A. Thomas S. Safford

[57] ABSTRACT

Catalytic conversion of a hydrocarbon feedstock comprising a stage of catalytic cracking of a hydrocarbon feedstock, a stage of separation of the products of cracking from the catalytic mass, and a stage of regeneration and recycling of the catalytic mass and between the stage of regeneration of the catalytic mass and the stage of separation of the products of cracking there is injected continuously or intermittently, at one or more points, in admixture with at least one hydrocarbon to be treated, at least one diorganophosphite of the general formula where $R_1$ and $R_2$, which may be alike or different, are selected from the group consisting of alkyl, aryl or aralkyl groups having from 1 to 30 carbon atoms.

13 Claims, 1 Drawing Sheet

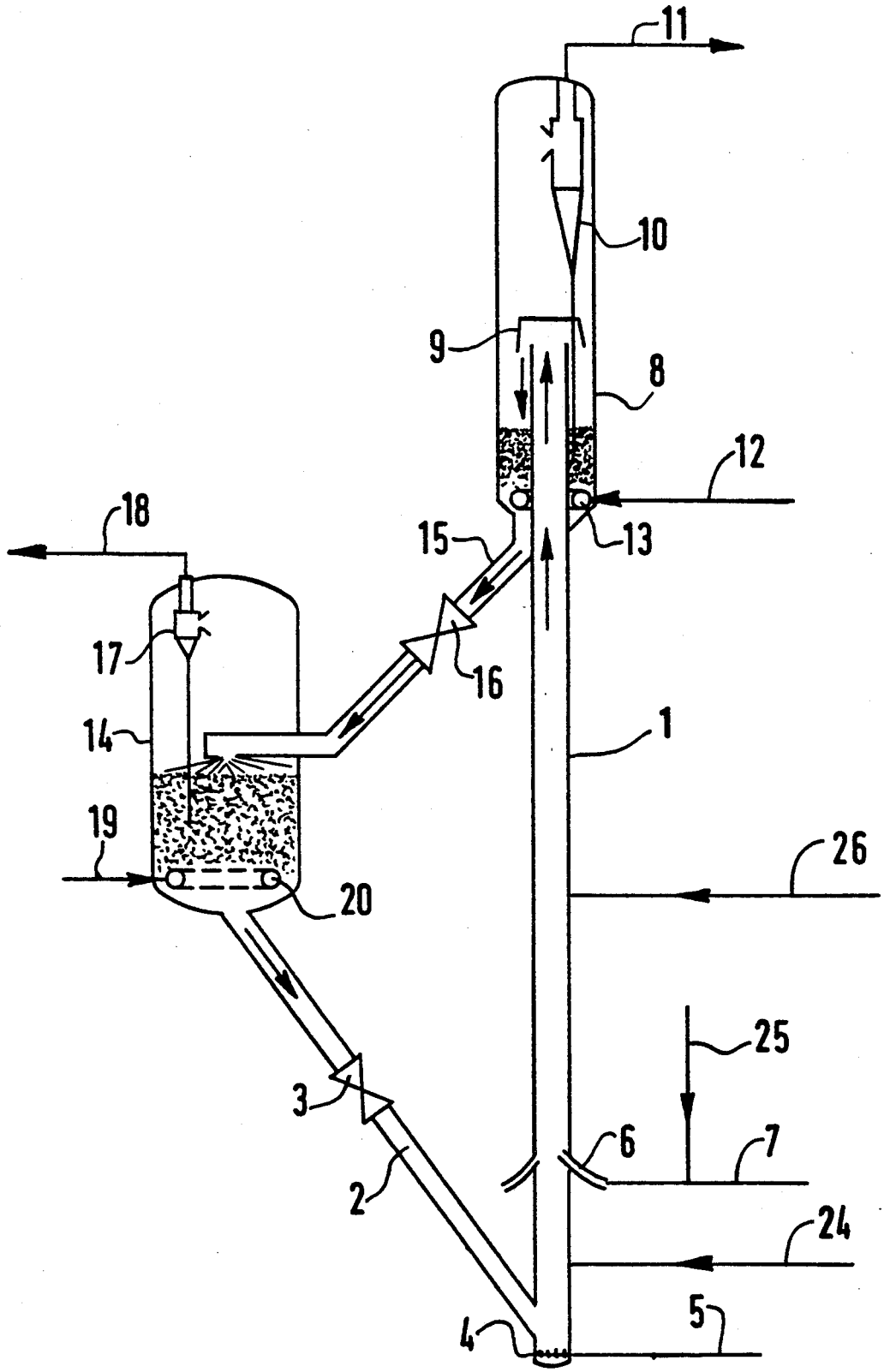
11
10
9
8
12
13
18
15
17
16
14
1
19
26
20
25
3
6
7
2
24
4
5

PROCESS FOR THE CATALYTIC CONVERSION OF A HYDROCARBON FEEDSTOCK

The present invention relates to a process for the catalytic conversion of a hydrocarbon feedstock. More particularly, it relates to the use as additives in such a process of organophosphorus compounds intended to limit the formation of coke during the conversion and to increase the yield of lighter hydrocarbon products of the conversion.

It is known that catalytic-cracking conversion processes are used routinely in the petroleum industry. They involve the contacting of the hydrocarbon feedstock with catalyst particles heated to a high temperature for the purpose of breaking down, by the effect of the temperature and in the presence of a catalytic mass, the hydrocarbon molecules into smaller molecules that distill at lower temperatures. At the same time, however, unwanted coke forms on the surface of the catalyst, which has an adverse effect on the heat balances and reduces the activity of the catalyst. The coke deposited on the catalyst consequently is a factor limiting the conversion level of the hydrocarbon feedstock entering the conversion unit, and thus reducing the liquid conversion to lighter products.

The liquid conversion is defined by the conversion yield of the liquefied petroleum gas, or LPG (gas in the liquid phase, consisting of the $C_3$ and $C_4$ hydrocarbons), in terms of gasoline and a 350° C. distillation cut or LCO (light cycle oil).

Certain additives are used to retard the formation of coke during the high-temperature treatment of hydrocarbons, and more particularly of crude petroleums, for example, during visbreaking, catalytic cracking and distillation. These are phosphorus in the form of elemental phosphorus, phosphorus pentoxide, phosphorus pentasulfide, tributyl phosphine and triethyl thiophosphite, or a mixture of these compounds, in the solid, liquid or vapor state or as a dispersion, or even in the form of a deposit on an alumina support. (See U.S. Pat. No. 3,647,677.)

In catalytic-cracking conversion reactions in a fluidized bed, it is also known to treat the deactivated catalyst in a separate additional stage distinct from regeneration with organic phosphorus derivatives to reduce the effect of the poisoning of the active sites of the catalyst by metals such as nickel, vanadium and other contaminating metals coming from the cracking reaction of the hydrocarbons treated. The phosphorus compounds generally utilized in this treatment of the catalyst (see U.S. Pat. No. 4,321,128) include the tertiary alkyl-, aryl- and aralkylphosphates, the tertiary alkyl-, aryl- and aralkylphosphines, the tertiary alkyl-, aryl- and aralkylphosphites and their halogenated derivatives, the corresponding thiophosphorus compounds, and phosphorus pentoxide and its hydrogenated and ammoniated derivatives. They are introduced in liquid form, in water or in an organic compound, into the regenerated catalyst, which after an oxidizing wash is sent back to the reaction zone. Certain phosphorus compounds, such as tricresyl phosphate or ammonium hydrogen phosphate, have been suggested as additives to the feedstock or to the catalyst (without an oxidizing treatment of the latter) for the purpose of passivating the contaminant metals present in the hydrocarbon feedstock of a fluid catalytic cracking process. (See U.S. Pat. No. 4,430,199.)

The applicants have found that certain organophosphorus compounds, the diorganophosphites, introduced into the hydrocarbon feedstock of a catalytic hydrocarbon conversion process such as catalytic cracking, are more effective than the known phosphorus compounds injected into the feedstock or deposited on the catalyst since they act simultaneously, directly on the instantaneous formation of coke during the conversion reaction to reduce the quantity of coke produced and to the increase of the liquid conversion of these hydrocarbons. These organophosphorus compounds represent the best compromise in that they promote an increased selectivity toward gasoline, a reduced selectivity to coke, a lower catalyst regeneration temperature, less production of catalyst slurry, a decrease in the production of hydrogen and dry gases, and an increased rate of catalyst circulation in the tank in which the process is carried out, which translates into a higher C/0 ratio (catalyst/hydrocarbon feedstock ratio), thus increasing the number of active sites in contact with the feedstock.

The present invention thus seeks to increase the liquid conversion while limiting the quantity of coke formed during a catalytic hydrocarbon conversion reaction by introducing one of these organophosphorus compounds into the reaction system before any conversion reaction takes place.

To this end, the present invention has as a preferred embodiment a process for the catalytic conversion of a hydrocarbon feedstock, said process comprising a stage of catalytic cracking of a hydrocarbon feedstock, a stage of separation of the products of cracking from the catalytic mass, and a stage of regeneration and recycling of the catalytic mass, said process being characterized in that between the stage of regeneration of the catalytic mass and the stage of separation of the products of cracking there is injected continuously or intermittently, at one or more points, alone or in admixture with at least one hydrocarbon to be treated, at least one organophosphite of the general formula

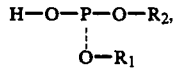

where $R_1$ and $R_2$, which may be alike or different, are selected from the group consisting of alkyl, aryl or aralkyl groups having from 1 to 30, and preferably from 1 to 10, carbon atoms.

The organophosphite may be injected intermittently or continuously.

Though equivalent to continuous injection, intermittent injection may prove more advantageous during the operation of the industrial unit as it may make it possible to reduce the total quantity of additive needed to practice the invention and to maintain a phosphorus level not more than constant in relation to the fresh feedstock injected into the reaction zone.

In another preferred embodiment of the invention, the $R_1$ and $R_2$ groups of the organophosphite compounds may be an alkyl group having from 1 to 4 carbon atoms.

Among the dialkylphosphites, diethyl phosphite is particularly preferred.

The organophosphite(s) may be injected in diluted form into at least one hydrocarbon to be treated, and preferably into the hydrocarbon feedstocks to be treated. To achieve optimum effectiveness of these compounds, they should be injected at a concentration in phosphorus of between 0.5 and 1,000 ppm, and preferably between 1 and 100 ppm, of phosphorus, based on the feedstock.

The heavy hydrocarbon feedstocks intended to be treated in the presence of the compounds in accordance with the present invention are preferably those whose boiling ranges are between 300° and 750° C., for example, vacuum distillates, atmospheric and vacuum residues, deasphalted oils, aromatic extracts, and catalytic- or thermal-cracking residues.

In the course of their work, the applicants have observed that, surprisingly, the inventive injection of diorganophosphorus compounds into the feedstock to be treated is much more effective, so far as reduction of coke formation and increase of conversion are concerned, than when these same organophosphorus compounds are introduced into the catalyst ahead of the feedstock. The diorganophosphorus compounds actually act directly on the compounds in the feedstock to be cracked which produce the coke and limit its formation, which promotes the liquid conversion, apart from any passivating effect on the metals.

Consequently, the diorganophosphites may be injected at one or more points at a time into the hydrocarbon feedstock(s) to be treated.

In a preferred embodiment of the invention, the phosphorus compounds are injected into the reaction zone. They may be introduced upstream of the injection device for the hydrocarbon feedstock to be converted, at a temperature between 20° and 450° C., for example, after dilution in appropriate hydrocarbons such as gasolines or gas oils to facilitate their dispersion.

The phosphorus compounds may also be introduced into the reaction zone, after dilution in the feedstock, ahead of or after the feedstock preheat circuit( at a temperature ranging from 50° to 450° C.

In another preferred embodiment, the diorganophosphites may be injected into a surge drum where they are contacted with the hydrocarbon feedstock for 15 minutes before the mixture so formed is injected into the reaction zone.

Finally, these compounds may be injected into the injection zone of the feedstock to be cracked, immediately after the injection of the latter, at between 80° and 300° C., diluted in at least one hydrocarbon, for example, in a light or heavy catalytic cutter stock of the LCO (light cycle oil) or HCO (heavy cycle oil) type, and atomized into the cracking zone, as described in French patent application 2 605,643.

BRIEF DESCRIPTION OF THE DRAWING

The invention will now be described in greater detail with reference to the single figure of the accompanying drawing, which illustrates the application of the invention to a fluid catalytic cracking unit with a riser and a single high-temperature regeneration chamber for the catalytic mass or catalyst particles.

The equipment for catalytic cracking in a rising fluidized phase essentially comprises a column 1, known as a riser. The latter is supplied at its base, through the line 2, with regenerated catalyst particles in a quantity determined either by the opening or closing of a valve 3 or by variation of the catalyst flow rate by means of a flow-control system known per se. The regenerated catalyst here is fluidized by injection at the base of the riser, with the aid of a diffuser 4, of steam delivered through the line 5.

The fresh hydrocarbon feedstock is introduced into the riser through an injector 6 of a type known per se, supplied through the line 7.

The column 1 discharges at its top into a chamber 8, which may, for example, be concentric with it and in which the products of cracking are separated from the catalyst particles by means of a ballistic separator and the coke-laden catalyst particles are stripped. The effluent hydrocarbons or products of cracking are discharged through a cyclone system 10, accommodated in the chamber 8, and then through the discharge line 11, located at its top, while the deactivated catalyst particles drop to the bottom of the chamber 8, where a line 12 supplies a stripping gas, usually steam, to diffusers 13, arranged uniformly about the bottom of the chamber 8.

The catalyst particles so stripped are discharged to a regenerator 14 through a pipe 15 in which a control valve 16 is provided. The regenerator 14 shown in the figure has only one zone for combustion in the presence of oxygen of the coke deposited on the catalyst particles.

This regeneration is performed in such a way that the heat liberated by the combustion of the coke is partly transferred to the catalyst particles to enable them to attain the temperatures, neither too high nor too low, necessary for the reaction in zone 1. The coke deposited on the particles is thus burned off by means of air injected at the bottom of the regenerator through a line 19 which supplies the diffuser 20. The catalyst particles entrained into the cyclone 17 are separated from the gases of combustion, which are discharged through a line 18, while the hot regenerated catalyst particles are withdrawn from the bottom of the regenerator and recycled through the pipe 2 to the intake of the riser.

In this catalytic cracking equipment, the diorganophosphites in accordance with the invention may be introduced at different points located along the riser 1.

They may be introduced through the line 25, after being diluted in the fresh feedstock in line 7. This dilution may take place ahead of or after the feedstock preheat circuit.

If necessary, the diaorganophosphite may also be introduced through a line 24, located upstream of the fresh-feedstock line 7, and/or through a line 26, located downstream of the fresh-feedstock line.

The diorganophosphite may be introduced at one or more of the aforesaid points but in such a manner that the quantity of phosphorus introduced by way of this compound is not greater on the basis of the hydrocarbon feedstock than the quantity that would have been introduced at a single point.

The results obtained by using the additive in accordance with the invention in a fluid-bed conversion process, and particularly in a fluid catalytic cracking process, are highly satisfactory, as will be seen from the examples which follow, and which are intended to illustrate the invention.

EXAMPLE 1

The purpose of this example is to show that the injection of a diorganophosphite in accordance with the invention into the reaction zone, particularly after dilution in the feedstock, is more effective so far as the conversion and the limitation of the quantity of coke formed during the reaction are concerned than when it is introduced into the catalyst during the reaction. The conversion process employed is a catalytic cracking process comprising a stage of contacting the hydrocarbon feedstock with catalyst particles so that the cracking reaction takes place, a stage of separation of the hydrocarbons resulting from the cracking reaction and of the coke-laden and deactivated catalyst particles, and a stage of regeneration of these catalyst particles by combustion of the coke. In this example, the process was operated in a pilot plant comprising a feed pump for the hydrocarbon feedstock, a reactor containing the fixed catalyst bed and further comprising an oxidizing-gas (oxygen) intake, a furnace surrounding the reactor, and a liquid/gas separation system. An inert-gas inlet is provided in the hydrocarbon-feedstock feed pipe (between the feed pump and the reactor) for the purpose of scavenging the feedstock before its entry into the reactor and of stripping the coke-laden catalyst after the feed of feedstock to the reactor has been shut off. The organophosphorus compounds will be introduced into the hydrocarbon feedstock between the feed pump and the reactor.

After each test, the catalyst is regenerated so that the results will be comparable.

The feedstock introduced is an atmospheric residue having the following characteristics:

| | |
|---|---|
| Density at 15° C. | 0.9352 |
| Index of refraction at 60° C. | 1.5082 |
| Viscosity at 70° C. ($mm^2/s$) | 38.34 |
| Viscosity at 100° C. ($mm^2/s$) | 12.16 |
| S (wt. %) | 2.63 |
| N, total (wt. %) | 0.2 |
| N, basic (ppm) | 465. |
| Conradson carbon (wt. %) | 2.87 |
| Aniline point (°C.) | 92.2 |
| Acid number (mg KOH/g) | 0.2 |
| Ni (ppm) | 10. |
| V (ppm) | 23. |
| Na (ppm) | 1.7 |
| C, aromatic (wt. %) | 20. |
| H (wt. %) | 11.7 |
| Saturated hydrocarbons (wt. %) | 43.5 |
| Olefins (wt. %) | 1.5 |
| Aromatics (wt. %) | 47.6 |
| Monoaromatics (wt. %) | 9.6 |
| Resins (wt. %) | 7.2 |
| Asphaltenes, $C_7$ (wt. %) | 0.2 |
| Asphaltenes, $C_5$ (wt. %) | 2.8 |
| True boiling point (TBP), simulated (°C.): | |
| 5 (wt. %) | 385 |
| 10 (wt. %) | 400 |
| 30 (wt. %) | 435 |
| 50 (wt. %) | 465 |
| 70 (wt. %) | 500 |
| 90 (wt. %) | 575 |
| 95 (wt. %) | 703 |

The cracking conditions are as follows:

| | |
|---|---|
| Preheat temperature of feedstock | 200° C. |
| Reaction temperature | 530° C. |
| Catalyst-to-hydrocarbon feedstock (C/O) ratio | 4.5 |
| Feedstock flow rate | 10 kg/hr |

The cracking effluents are analyzed by gas chromatography. The quantity of coke deposited on the catalyst during the reaction is determined by combustion in air.

The catalyst used in the control test T1 is a new catalyst of the ultrastable type with a specific surface area of 220 $m^2/g$ and a pore volume of 0.26 $cm^3/g$. It contains 26 percent by weight of alumina with a high-silica matrix. It is deactivated at 770° C. with steam for 15 hours before it is contacted with the additive-free feedstock.

For the control test T2, this same new catalyst is impregnated with 5,000 ppm of diethyl phosphite before being treated with steam.

For the control test T3, the same catalyst is used as before but at equilibrium, that is, containing 7,600 ppm of the nickel/vanadium (Ni+V) mixture provided by the feedstock.

For test A in accordance with the invention, the same catalyst is used as for test T3; however, 1,000 ppm of phosphorus in the form of diethyl phosphite is introduced into the feedstock.

For the control test T4, the catalyst from test A is used, but the feedstock is not doped with diethyl phosphite.

Table 1 which follows presents the conversion-product yields resulting from five tests conducted by introducing an organophosphite, diethyl phosphite, either into the catalyst or into the feedstock.

TABLE 1

| Yields/feedstock (wt. %) | T1 | T2 | T3 | A | T4 |
|---|---|---|---|---|---|
| Conversion [1] | 58.4 | 66.4 | 65.2 | 66.4 | 63.1 |
| Gasoline ($C_5$–220° C.) | 41.9 | 45.5 | 37.5 | 41.5 | 39.0 |
| LCO (220–350° C.) [2] | 16.3 | 15.2 | 15.0 | 15.8 | 15.5 |
| Slurry (350° C.+) [3] | 25.3 | 18.5 | 19.9 | 17.8 | 21.3 |
| Coke | 1.8 | 3.4 | 9.7 | 7.3 | 7.7 |
| $H_2$ | 0.04 | 0.06 | 0.49 | 0.42 | 0.49 |
| Total $C_3$'s | 4.4 | 5.4 | 5.6 | 5.6 | 5.6 |
| Total $C_4$'s | 8.7 | 0.5 | 9.6 | 9.2 | 8.0 |
| Gasoline/conversion | 0.717 | 0.685 | 0.575 | 0.625 | 0.618 |
| Coke/conversion | 0.031 | 0.051 | 0.148 | 0.110 | 0.122 |
| Liquid conversion [4] | 71.3 | 76.6 | 67.7 | 72.1 | 68.1 |

[1] (220° C.– plus coke)
[2] Light catalytic cutter stock
[3] Catalytic residue
[4] Gasoline plus LCO plus total $C_3$'s plus total $C_4$'s, or LC 350 (liquid conversion at 350° C.–).

This table shows that when the catalyst is impregnated with an organophosphite, and more particularly with diethyl phosphite, and treated with steam, its stability is improved. (Compare test T2 with test T1.) This is known in the prior art. However, a deterioration of the selectivities is observed, that is, a lower selectivity toward gasoline (gasoline/conversion) and a more pronounced selectivity toward coke (coke/conversion).

It will be noted that the coke contents given for the control tests T1 and T2 are very much lower than those resulting from the control tests T3 and T4 and from test A in accordance with the invention, because of the absence of metals on the catalyst.

In contrast thereto, the introduction of an organophosphite into the feedstock results in an improvement in its selectivities. (Test A as against test T3.) Moreover, the catalyst which has been impregnated with phosphorus by injection of an organophosphite into the feedstock and then regenerated is less effective with respect to an nondoped feedstock than to a doped feedstock. (Test T4 as against test A.)

These tests underline the advantage of the introduction of a phosphorus compound in accordance with the invention into the feedstock to a catalytic cracking unit over the introduction of the same compound into the catalyst, regardless of the method used to impregnate it. They further show that it is much more advantageous for the operation of the process to add the organophosphorus compound to the heavy feedstock to be treated before the latter is injected into the reaction zone than to introduce it into the catalyst, regardless of the method of impregnation employed.

Moreover, the effect of the organophosphorus additives of the invention is independent of any metal-passivating effect.

EXAMPLE 2

The purpose of this example is to show that the organophosphites of the invention represent a better compromise than phosphoric acids and phosphates with respect to increasing the conversion, the selectivity toward gasoline, and the selectivity toward coke in the treatment of a hydrocarbon feedstock of the atmospheric-residue type.

The process employed, the feedstock, and the cracking conditions are the same in this example as in Example 1. The catalyst used is identical with the one of test T3 of Example 1. The quantity of phosphorus introduced continuously into the feedstock by way of phosphorus compounds is 1,000 ppm.

Table 2 which follows presents the results of comparative tests obtained with an additive in accordance with the invention, diethyl phosphite or DEP (test B), and with prior-art organophosphites, namely, 2-ethylhexyl phosphate or 2EHP (control test T6), butylphosphoric acid or BPA (control test T7), and octylphosphoric acid or OPA (control test T8).

TABLE 2

| Yields/ feedstock (wt. %) | T5 No p injection into feed-stock | T6 2EHP | B DEP | T7 BPA | T8 OPA |
|---|---|---|---|---|---|
| ppm P/catalyst on completion of injection | 0 | 1090 | 995 | 1854 | 1850 |
| Conversion | 65.2 | 69.6 | 66.4 | 68.2 | 65.9 |
| Gasoline ($C_2$–220° C.) | 37.5 | 41.4 | 41.5 | 40.6 | 38.2 |
| LCO (220–350° C. | 15.0 | 14.6 | 15.8 | 14.7 | 15.8 |
| Slurry (350° C.+) | 19.9 | 15.8 | 17.9 | 17.2 | 18.9 |
| Coke | 9.7 | 8.9 | 7.3 | 7.2 | 9.7 |
| $H_2$ | 0.49 | 0.48 | 0.42 | 0.32 | 0.49 |
| $C_1 + C_2$ | 2.2 | 2.4 | 2.2 | 2.4 | 2.2 |
| Total $C_3$'s | 5.6 | 6.2 | 5.6 | 6.6 | 5.6 |
| Total $C_4$'s | 9.6 | 10.0 | 9.2 | 10.9 | 9.5 |
| Gasoline/ conversion | 0.57 | 0.59 | 0.62 | 0.59 | 0.58 |
| Coke/ conversion | 0.148 | 0.127 | 0.109 | 0.105 | 0.147 |
| Liquid conversion (LC 350) | 67.7 | 72.2 | 72.1 | 72.8 | 69.1 |

With all phosphorus compounds, an increase in the liquid conversion LC 350 (gasoline plus LCO plus total $C_3$'s plus total $C_4$'s) is observed by comparison with control test T5. Compared to the other compounds, DEP (diethyl phosphite) represents the best compromise in that it makes possible a further reduction in coke formation, a better selectivity toward gasoline (gasoline/conversion), and less production of dry gases ($C_1$ plus $C_2$).

EXAMPLE 3

The purpose of this example is to demonstrate the superiority of the organophosphites over the organophosphites in the treatment of vacuum-distillate feedstock whose characteristics are as follows:

| | |
|---|---|
| Density at 15° C. | 0.9233 |
| Index of refraction at 60° C. | 1.5012 |
| Viscosity at 60° C. ($mm^2/s$) | 39.64 |
| Viscosity at 100° C. ($mm^2/s$) | 10.61 |
| Conradson carbon (wt. %) | 0.74 |
| Hydrogen (wt. %) | 12.2 |
| Sulfur (ppm) | 14,500 |
| Saturated hydrocarbons (wt. %) | 43.3 |
| Olefins (wt. %) | 0.7 |
| Aromatics (wt. %) | 50.8 |
| Monoaromatics (wt. %) | 7.0 |
| Diaromatics (wt. %) | 5.1 |
| Resins (wt. %) | 5.2 |
| Simulated distillation: | |
| 5 wt. %, ° C. | 368 |
| 10 wt. %, °C. | 393 |
| 30 wt. %, °C. | 431 |
| 50 wt. %, °C. | 468 |
| 70 wt. %, °C. | 511 |
| 90 wt. %, °C. | 583 |
| 99 wt. %, °C. | 715 |

The process employed and the cracking conditions are the same in this example as those described in Example 1.

The catalyst used is an equilibrium catalyst of the ultrastable type with a high-alumina (40 wt. %) matrix and a specific surface area of 110 $m^2/g$. At equilibrium, it contains 3,720 ppm of a nickel/vanadium (Ni+V) mixture. The test conditions are identical with those of Example 1. The phosphorus content of the feedstock is 1,000 ppm as in Example 2.

Table 3 which follows shows the results obtained when diethyl phosphite or DEP (test C), 2-ethylhexyl phosphate or EHP (control test T10), and tributyl phosphate or TBP (control test T11) are injected into the feedstock.

TABLE 3

| Yields/feedstock (wt. %) | T9 No P injection into feed-stock | C DEP | T10 2EHP | T11 TBP |
|---|---|---|---|---|
| ppm P/catalyst | 0 | 1340 | 640 | 1040 |
| Conversion | 68.7 | 68.1 | 71.9 | 72.1 |
| Gasoline ($C_5$–220° C.) | 44.3 | 45.2 | 44.7 | 45.5 |
| LCO (220–350° C.) | 15.90 | 16.3 | 14.9 | 15.0 |
| Slurry (350° C.+) | 14.7 | 15.7 | 12.5 | 12.2 |
| Coke | 4.6 | 3.7 | 5.4 | 4.6 |
| $H_2$ | 0.27 | 0.17 | 0.26 | 0.27 |
| $C_1 + C_2$ | 2.4 | 2.1 | 2.5 | 2.7 |
| Total $C_3$'s | 6.6 | 6.0 | 7.4 | 7.3 |
| Total $C_4$'s | 10.4 | 10.1 | 11.5 | 11.7 |
| Gasoline/conversion | 0.64 | 0.66 | 0.62 | 0.63 |
| Coke/coversion | 0.066 | 0.054 | 0.075 | 0.063 |
| Liquid conversion (LC 350) | 77.2 | 77.6 | 78.5 | 79.5 |

On the basis of these results, it appears that diorganophosphites, and more particularly diethyl phosphite, represent the best compromise in the treatment of vacuum distillate for obtaining simultaneously better gasoline selectivity (gasoline/conversion), a sharper reduction of the quantity of coke formed, and reduced production of dry gases ($C_1$ and $C_2$).

EXAMPLE 4

The purpose of this example is to demonstrate that diorganophosphites, and more particularly dialkylphosphites, represent a better compromise than trialkylphosphites between the objectives to be attained with this process for the cracking of a hydrocarbon feedstock.

In this example, the process employed, the nature of the catalyst, the nature of the feedstock and its phosphorus content are identical with those of Example 3. The cracking conditions are the same as those in Example 3, except for the C/O (catalyst-to-hydrocarbon feedstock) ratio, which here is 3.8 instead of 4.5.

In this example, four phosphorus compounds were introduced into the feedstock, namely, dimethyl phosphite or DMP (test E), dibutyl phosphite or DBP (test F), triethyl phosphite or TEP (test G), and trimethyl phosphate or TMP (control test T13).

The results obtained are presented in Table 4 which follows.

TABLE 4

| Yields/feedstock (wt. %) | T12 No P injection into feedstock | E DMP | F DBP | G TEP | T13 TMP |
|---|---|---|---|---|---|
| Conversion | 60.0 | 65.2 | 63.1 | 61.2 | 58.3 |
| Gasoline ($C_5$–220° C.) | 40.6 | 42.0 | 42.8 | 41.1 | 39.2 |
| LCO (220–350° C.) | 17.7 | 17.6 | 18.2 | 18.6 | 18.0 |
| Slurry (350° C.+) | 22.3 | 17.2 | 18.7 | 20.2 | 23.7 |
| Coke | 4.2 | 4.1 | 3.9 | 4.1 | 4.0 |
| $H_2$ | 0.29 | 0.29 | 0.26 | 0.27 | 0.25 |
| $C_1 + C_2$ | 1.8 | 1.9 | 1.7 | 1.9 | 2.0 |
| Total $C_3$'s | 4.8 | 6.0 | 5.1 | 5.0 | 4.8 |
| Total $C_4$'s | 7.7 | 10.1 | 9.2 | 8.1 | 7.45 |
| Gasoline/conversion | 0.676 | 0.644 | 0.678 | 0.671 | 0.672 |
| Coke/conversion | 0.07 | 0.062 | 0.062 | 0.066 | 0.068 |
| Liquid conversion (LC 350) | 70.8 | 75.7 | 75.3 | 72.8 | 69.4 |

As is apparent from this table, all diorganophosphites tested improve the liquid conversion (LC 350) while reducing the coke selectivity (coke/conversion) by comparison with trimethyl phosphate (TMP). Of the organophosphites, the dialkylphosphites (DMP and DBP) are more effective than the trialkylphosphite (TEP), as reflected in the improvement in liquid conversion, in the reduction of the selectivity toward coke (coke/conversion), and in the limitation of slurry production (slurry 350° C.+).

EXAMPLE 5

This example is intended to show that the lowering of coke production due to the injection of phosphorus compounds in accordance with the invention permits the regeneration temperature of the catalyst to be reduced and the circulation of the catalyst to be increased. The catalyst used in this example is the same as the one described in Example 3, and the amount of phosphorus introduced into the feedstock by way of organophosphorus compounds is 30 ppm. The feedstock is a vacuum distillate with a high nitrogen content, whose characteristics are as follows:

| | |
|---|---|
| Density at 15° C. | 0.942 |
| Viscosity at 100° C. (cs) | 17.300 |
| Viscosity at 60° C. (cs) | 91.030 |
| Molecular weight | 480.581 |
| Index of refraction at 60° C. | 1.509 |
| Aniline point (°C.) | 80.600 |
| Sulfur (wt. %) | 0.900 |
| Nitrogen (ppm) | 2,100.000 |
| Basic nitrogen (ppm) | 1,015.000 |
| Nickel (ppm) | 1.900 |
| Vanadium (ppm) | 1.000 |
| $H_2$ (wt. %) | 11.900 |
| Conradson carbon (wt. %) | 1.080 |
| Saturateds (wt. %) | 41.100 |
| Olefins (wt. %) | 1.200 |
| Aromatics (wt. %) | 48.100 |
| Monoaromatics (wt. %) | 13.100 |
| Diaromatics (wt. %) | 9.100 |
| Resins (wt. %) | 9.600 |

In this example, an additive in accordance with the invention, diethyl phosphite or DEP (test H and I), is compared with a tributyl phosphate or TBP (control tests T15 and T16). The results of these tests are presented in Table 5 which follows.

TABLE 5

| Yields/feedstock (wt. %) | T14 No P injection into feedstock | H C/O = 6 DEP | T15 C/O = 6 TBP | I C/O = 6.8 DEP | T16 C/O = 6.3 TBP |
|---|---|---|---|---|---|
| ppm P/catalyst on completion of injection | 0 | 15,000 | 15,000 | 15,000 | 15,000 |
| Conversion | 60.1 | 60.9 | 63.7 | 60.7 | 62.6 |
| Gasoline ($C_5$–220° C.) | 40.1 | 41.1 | 42.9 | 40.8 | 41.5 |
| LCO (220–350° C.) | 18.9 | 18.7 | 17.7 | 18.8 | 18.2 |
| Slurry (350° C.+) | 20.7 | 20.4 | 18.5 | 20.7 | 19.7 |
| Coke | 5.7 | 5.2 | 5.7 | 5.5 | 5.7 |
| $H_2$ | 0.32 | 0.26 | 0.27 | 0.29 | 0.31 |
| $C_1 + C_2$ | 4.1 | 3.8 | 3.9 | 4.1 | 4.2 |
| Total $C_3$'s | 3.9 | 4.0 | 4.2 | 3.9 | 4.0 |
| Total $C_4$'s | 6.4 | 6.5 | 6.8 | 6.1 | 6.3 |
| Gasoline/conversion | 0.667 | 0.675 | 0.674 | 0.672 | 0.669 |
| Coke/conversion | 0.095 | 0.085 | 0.089 | 0.091 | 0.092 |
| Liquid conversion (LC 350) | 69.3 | 70.3 | 71.6 | 69.6 | 69.7 |
| Delta coke | 0.94 | 0.88 | 0.85 | 0.92 | 0.90 |
| Regenerator temperature (°C.) | 714 | 700 | 690 | 710 | 703 |

As in the preceding examples, diethyl phosphite, the preferred diorganophosphite in accordance with the invention, represents the best compromise in that it increases both the liquid conversion and the gasoline selectivity (gasoline/conversion) while lowering both the coke selectivity (coke/conversion) and the production of dry gases ($C_1$ and $C_2$). On the other hand, the lowering of the regeneration temperature is far more pronounced in the case of DEP because of the sharper drop in coke production.

So far as the process is concerned, this drop entails an increase in catalyst circulation, and hence of the C/O ratio. This is illustrated by the tests I and T16. Again, DEP represents the best compromise since it permits a reduction of the production of slurry, a decrease in the selectivity toward coke, and an increase in liquid conversion (LC 350) and in gasoline selectivity.

All these examples thus show that organophosphites represent a better compromise than the prior-art compounds with respect to liquid conversion (LC 350), gasoline selectivity (gasoline/conversion), coke selectivity (coke/conversion), and production of dry gases ($C_1$ plus $C_2$), regardless of the nature of the feedstock and regardless of the catalyst-to-hydrocarbon feedstock (C/O) ratio ranging from 3 to 6.

This specification is based upon a French priority document, France No. 8913447, filed Oct. 13, 1989, which is incorporated herein by reference.

We claim:

1. A process for the catalytic conversion of a hydrocarbon feedstock, comprising injecting a hydrocarbon feedstock into a bed of catalytic particles and catalyticly cracking said hydrocarbon feedstock in a reaction zone containing such bed, separating the products of cracking from the catalytic particles; regenerating and recycling the separated catalytic particles; and, between the step of regenerating the catalytic particles and the step of separating the products of cracking, injecting continuously or intermittently at at least one point, a mixture consisting essentially of at least one hydrocarbon to be treated, and at least one diorganophosphite of the general formula

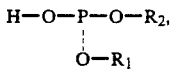

where $R_1$ and $R_2$, which may be alike or different, are selected from the group consisting of alkyl, aryl or aralkyl groups having from 1 to 4 carbon atoms.

2. A process according to claim 1, wherein the diorganophosphite is diethyl phosphite.

3. A process according to claim 1, wherein the diorganophosphite is injected at a concentration in phosphorus of between 0.5 and 1,000 ppm, based on the quantity of hydrocarbon feedstock to be converted.

4. A process according to claim 3, wherein the diorganophosphite is diethyl phosphite and is injected into the reaction zone of the hydrocarbon feedstock.

5. A process according to claim 4, wherein the diorganophosphite is injected into the reaction zone at a temperature between 20° and 450° C., at one or more points upstream of the injection of the hydrocarbon feedstock.

6. A process according to claim 5, wherein the diorganophosphite is diluted in gasoline prior to injection.

7. A process according to claim 4, wherein the diorganophosphite is diluted in the hydrocarbon feedstock and then is injected into the reaction zone at between 50° and 450° C.

8. A process according to claim 7, wherein the organophosphate is injected into a surge drum containing the hydrocarbon feedstock and maintained in contact with the feedstock for at least 15 minutes before the mixture is injected into the reaction zone.

9. A process according to claim 4, wherein the diorganophosphite is injected into a zone of injection of the feedstock to be cracked, at between 80° and 300° C., at least one point located immediately downstream of a point of injection for the hydrocarbon feedstock.

10. A process according to claim 9, wherein the diorganophosphite is diluted in light and heavy cutter stocks prior to injection.

11. A process according to claim 1, wherein the diorganophosphite is injected into hydrocarbon feedstock to be treated, at a concentration in phosphorus of between 0.5 and 1,000 ppm, based on the quantity of hydrocarbon feedstock to be converted.

12. A process according to claim 1, wherein the diorganophosphite is injected into the reaction zone of the hydrocarbon feedstock.

13. A process according to claim 1, wherein injection of the diorganophosphite is intermittent such that a quantity of phosphorus is maintained constant in the reaction zone.

* * * * *